US006140566A

United States Patent [19]

Tamura

[11] Patent Number: 6,140,566

[45] Date of Patent: Oct. 31, 2000

[54] MUSIC TONE GENERATING METHOD BY WAVEFORM SYNTHESIS WITH ADVANCE PARAMETER COMPUTATION

[75] Inventor: Motoichi Tamura, Hamamatsu, Japan

[73] Assignee: Yamaha Corporation, Hamamatsu, Japan

[21] Appl. No.: 09/274,856

[22] Filed: Mar. 23, 1999

Related U.S. Application Data

[62] Division of application No. 09/032,091, Feb. 27, 1998, Pat. No. 5,913,258.

[30] Foreign Application Priority Data

Mar. 11, 1997 [JP] Japan ..... 9-072845

[51] Int. Cl.[7] ..... G10H 1/22; G10H 1/26

[52] U.S. Cl. ..... 84/609; 84/618; 84/DIG. 2

[58] Field of Search ..... 84/609–614, 618, 84/DIG. 2

[56] References Cited

U.S. PATENT DOCUMENTS 5,696,342 12/1997 Shimizu .

*Primary Examiner*—Stanley J. Witkowski

*Attorney, Agent, or Firm*—Graham & James LLP

[57] ABSTRACT

Musical tones are produced according to song data basically by three steps. The first step converts the song data sequentially into control parameters. The control parameters are written into a parameter memory. Then, the second step generates waveform data by using the control parameters written in the parameter memory. The generated waveform data are written into a waveform memory, while the used control parameters are erased from the parameter memory to provide a vacant area. Lastly, the third step reads the waveform data sequentially from the waveform memory to produce the musical tones. Characterizingly, the second step of generating waveform data is executed dependently on progression of the third step of reading the waveform data. Further, the first step of converting the song data is executed independently from progression of the second step of generating waveform data as long as the parameter memory has the vacant area sufficient to store the control parameters converted from the song data.

10 Claims, 14 Drawing Sheets

MUSIC TONE GENERATING METHOD BY WAVEFORM SYNTHESIS WITH ADVANCE PARAMETER COMPUTATION

This is a division or application Ser. No. 09/032,091, filed Feb. 27, 1998 and now U.S. Pat. No. 5,913,258.

BACKGROUND OF THE INVENTION

1. Field of the Invention

The present invention generally relates to a method of generating a music tone based on supplied song data such as MIDI data. In particular, the present invention relates to a music tone generating method applicable to a software sound source that reproduces a stream of MIDI data while receiving the same through a network.

2. Description of Related Art

A software sound source is known which implements a sound source by means of software without taking to special hardware. The supplied song data is reproduced using such a software sound source.

Recently, the song data is sometimes downloaded from a network for reproduction. A request for song data is sent from a computer to a server through a network such as the Internet. The server distributes the requested song data to the computer. To be more specific, the computer requests for song data embedded in a home page of the WWW (World Wide Web) as a tag based on HTML (Hyper Text Modeling Language) at the time of downloading of this home page. Otherwise, a user requests for MIDI file prepared on an FTP (File Transfer Protocol) server by clicking a particular position on the screen of the computer. The song data includes a standard MIDI file (SMF) and a multimedia file such as a karaoke file in which SMF is combined with image data and/or words data.

On the computer, softwares such as a Web browser is executed to receive the song data. Generally available Web browsers include Netscape (trademark of Netscape Communications Corporation) and Internet Explorer (trademark of Microsoft Corporation). The Web browsers have a capability of downloading a song data file from the server according to the above-mentioned technique.

There are various application software in the field of DTM such as "MIDIPLUG" (trademark of Yamaha Corporation), "Crescendo" (trademark of Live Up Date Corporation), and "Karaku" (trademark of Yamaha Corporation). The "MIDIPLUG" is a software sound source having main timbres of the XG standard, and starts reproducing of the music tones upon complete reception of MIDI data. The "Crescendo" is a player that outputs MIDI data to an external MIDI sound source made of local hardware or software every time the received MIDI data is accumulated to a certain degree while receiving the MIDI data. These software sound source and player are plug-in software incorporated in browsers for browsing home pages in the WWW so as to add new capabilities to the browsers. In the future, these software programs may become a standard capability of the browsers. The "Karaku" is a software package for the communication karaoke for presenting lyric words and music performance in synchronization.

FIG. 14 is a diagram illustrating operation of a conventional software sound source to carry out the music tone generating method. In the figure, reference numeral 121 denotes a MIDI data input timing, reference numeral 12 denotes a sound source parameter generating period, and reference numeral 14 denotes a waveform data generating period. In the music tone generating method using the conventional software sound source, a sound source driver inputs MIDI data at the MIDI data input timing 121 in a time frame (F−2) to generate a sound source parameter in the sound source parameter generating period 12. In the wave data generating period 14 of the next time frame (F−1), the sound source driver generates waveform data according to the sound source parameter. The waveform data thus generated is reproduced in a second next time frame (F). The sound source parameter generation is performed by discontinuing or interrupting the waveform generation every time MIDI data is inputted. Therefore, if performance events such as note-on, note-off and pitch bend concentrate in a particular time frame, for example at time frame (F−2), the CPU load extremely increases in this time frame to adversely affect the sound source computation, thereby causing a problem of incomplete waveform generation which would miss a part of simultaneous music tones.

SUMMARY OF THE INVENTION

It is therefore an object of the present invention to provide a music tone generating method of temporally leveling or distributing a work load spent for generating waveform data from song data so as to substantially and practically reduce the effective work load per time. Another object is to provide a music tone generating method of starting reproduction of a song without waiting for downloading of all song data when reproducing music tones by downloading the song data from a network.

In carrying out the invention and according to one aspect thereof, there is provided a music tone generating method comprising: a first step for sequentially converting supplied song data into a parameter and storing the same into a first memory; a second step for generating waveform data based on the parameter stored in the first memory and storing the generated waveform data into a second memory and, at the same time, freeing, in the first memory, an area in which the parameter used for generation of the waveform has been stored; and a third step for reproducing the waveform data stored in the second memory to generate a music tone. The second step generates the waveform data as the reproduction of the waveform data by the third step progresses, and the first step executes the conversion of the above-mentioned parameter if there is a free or vacant area in the first memory. Thus, the processing of generating the waveform data from the song data is divided into a portion in which the generation is performed according to the progression of the waveform data reproduction and another portion in which the parameter conversion can be executed independently of the generation of the waveform. The parameter conversion processing can be performed in advance when allowed by the storage capacity of the first memory, which serves as the buffer for the conversion processing. Consequently, the work load of reproducing the waveform data from the song data is temporally leveled or distributed along time axis to avoid incidental concentration of the work load.

In carrying out the invention and according to another aspect thereof, there is provided a music tone generating method comprising: a first step for receiving song data supplied via a communication line and storing the received song data into a first memory; a second step for converting the song data stored in the first memory into a parameter and storing the same into a second memory; a third step for generating waveform data based on the parameter stored in the second memory and storing the generated waveform data into a third memory and, at the same time, freeing, in the second memory, an area in which the parameter used for generating the waveform data has been stored; and a fourth step for reproducing the waveform data stored in the third memory to generate a music tone. The third step generates the waveform data as the reproduction of the waveform data in the fourth step progresses. The second step executes the conversion of the song data to the parameter if there is a free area in the second memory and if there is song data not yet converted into parameters in the first memory. Thus, the inventive method of the second aspect provides the same effect as that of the inventive method of the first aspect, and additionally performs the parameter conversion processing if the first memory contains song data not yet converted into parameters, thereby starting song reproduction without waiting until the song data is all downloaded through the communication line.

BRIEF DESCRIPTION OF THE DRAWINGS

These and other objects of the invention will be seen by reference to the description, taken in connection with the accompanying drawings, in which.

DETAILED DESCRIPTION OF PREFERRED EMBODIMENTS

This invention will be described in further detail by way of example with reference to the accompanying drawings.

Figure 1:
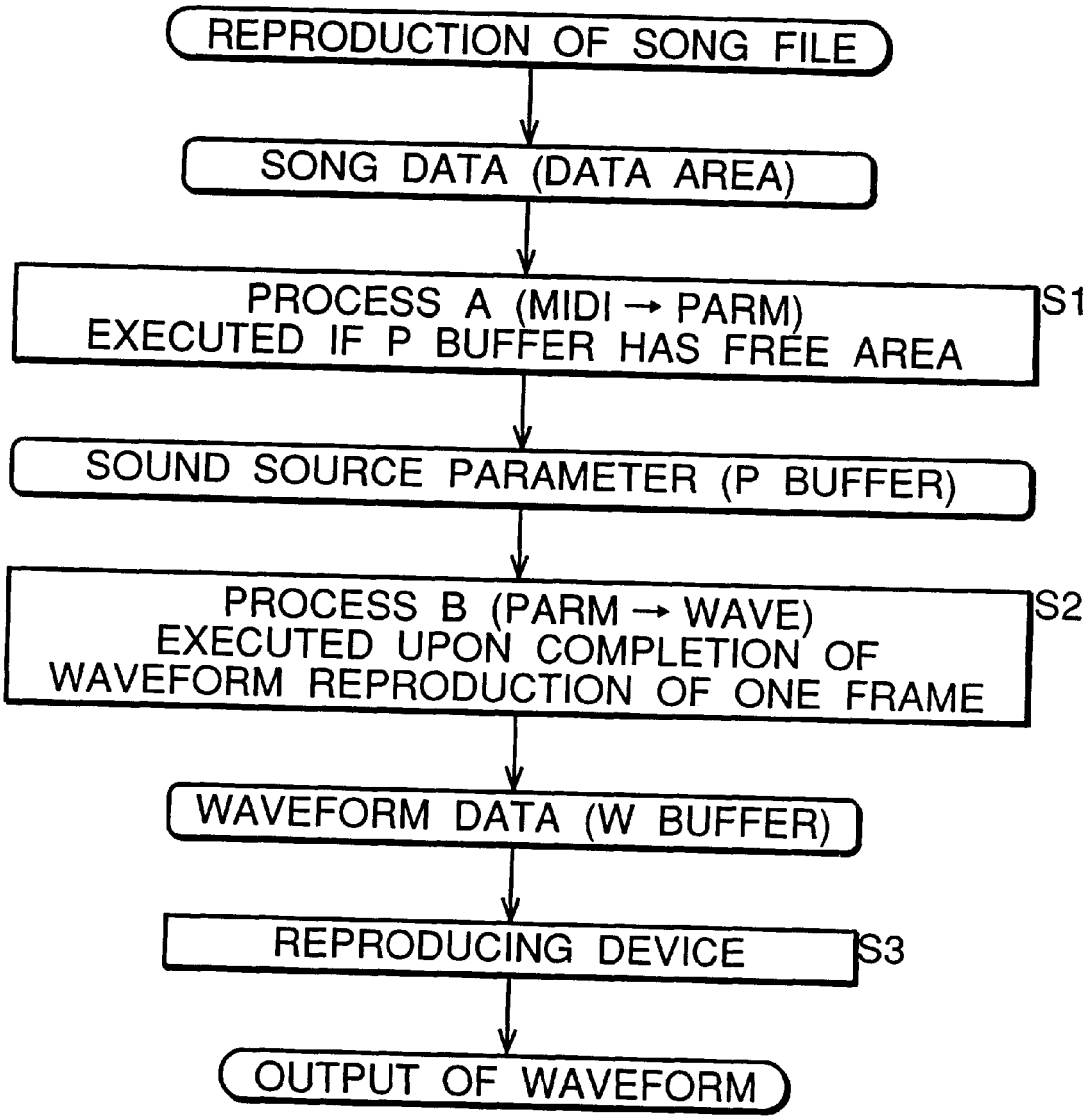
FIG. 1 is a diagram illustrating flow of processing by a music tone generating method practiced as a first preferred embodiment of the present invention.
Figure 2:
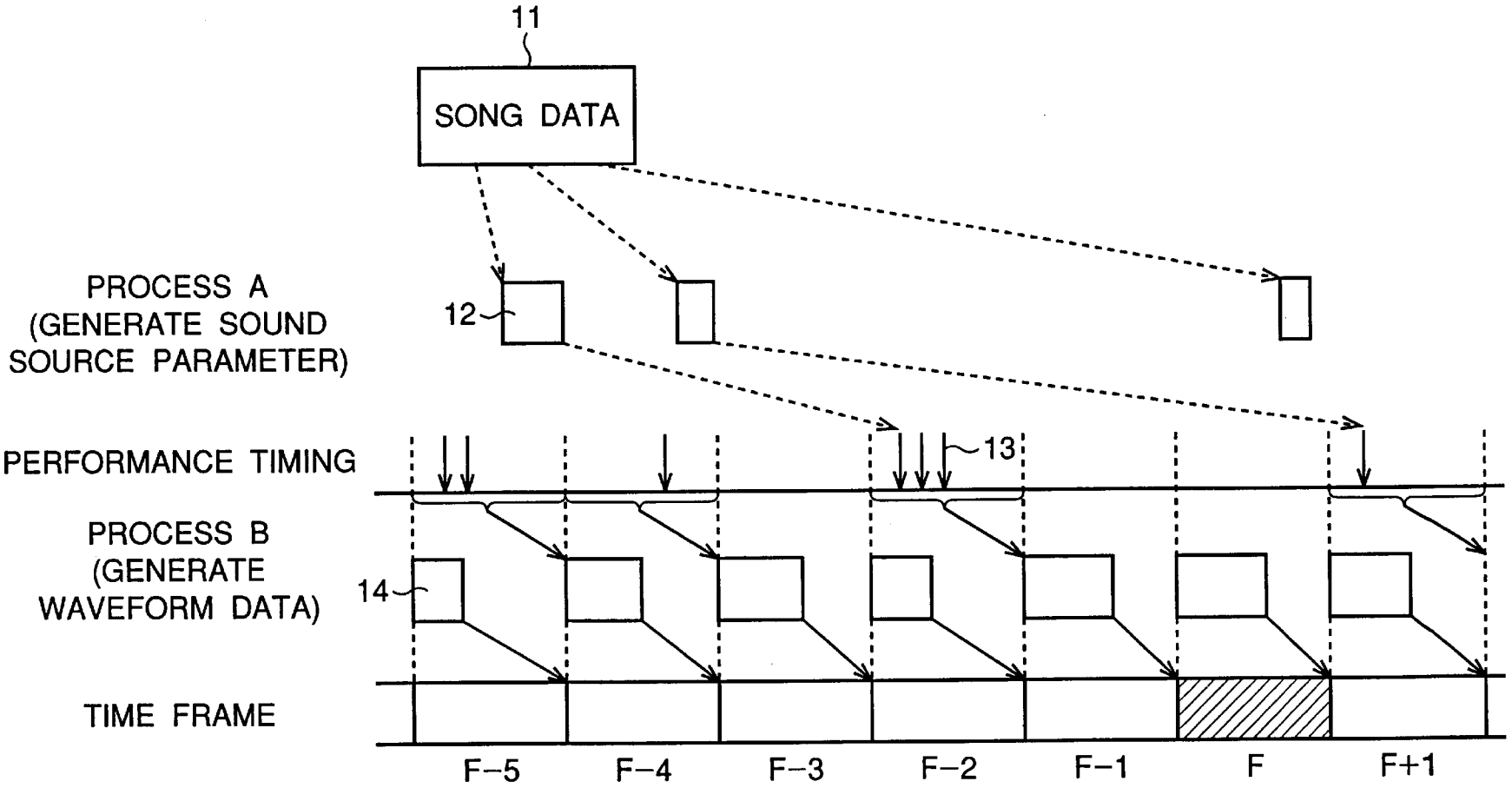
FIG. 2 is a timing chart illustrative of the first preferred embodiment.
Figure 14:
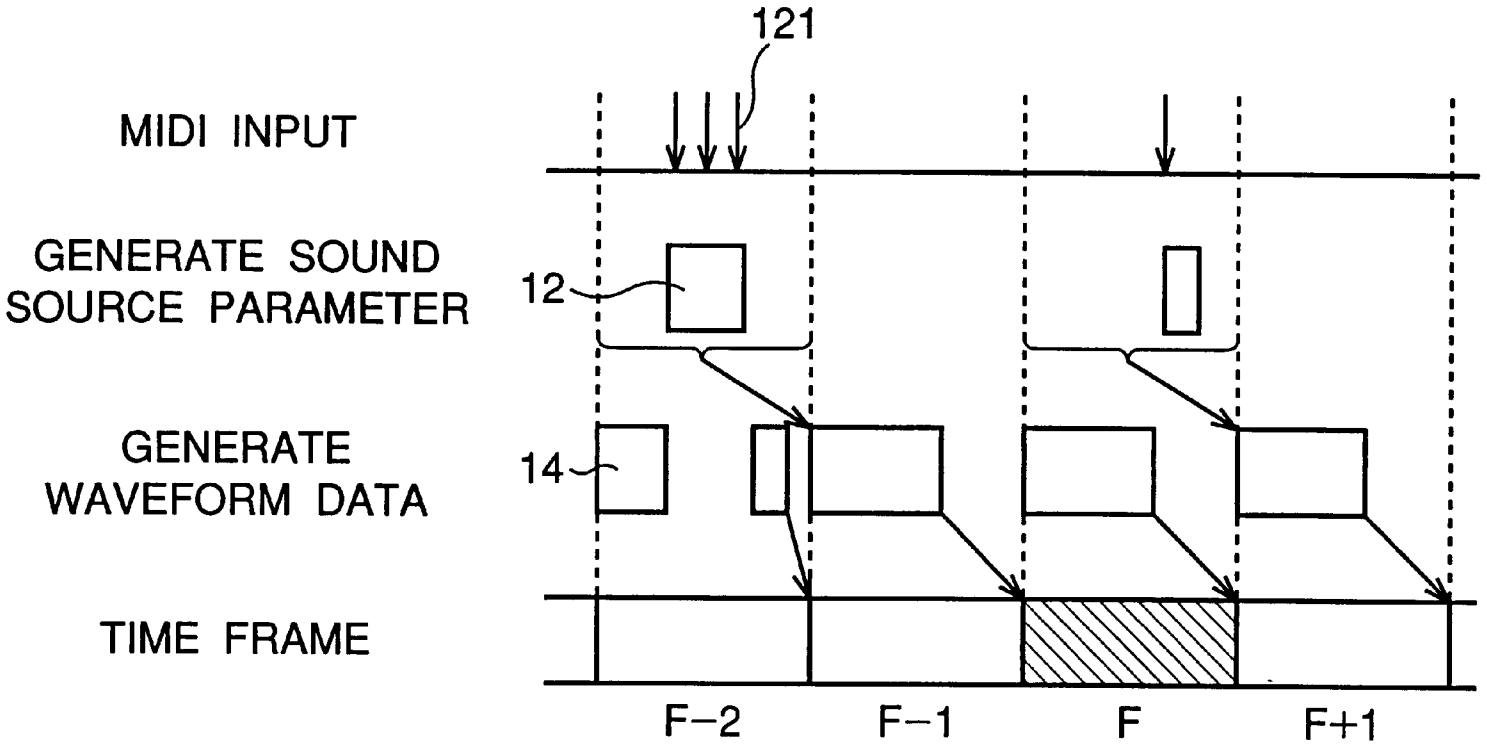
FIG.14 PRIOR ART
FIG. 14 is a diagram illustrating operation of a conventional music tone generating method.

Now, referring to FIG. 1, there is shown a diagram illustrating a flow of processing in a music tone generating method practiced as a first preferred embodiment of the present invention. FIG. 2 shows a timing chart of the music tone generating method of the first preferred embodiment. With reference to FIG. 2, portions similar to those previously described with reference to FIG. 14 are denoted by the same references for simplified description. Reference numeral 11 denotes song data. Reference numeral 13 denotes a performance timing. The first preferred embodiment reproduces song data in a song file for automatic performance locally arranged beforehand.

The song data 11 shown in FIG. 2 is stored in a data area. This song data 11 includes a sequence of performance events. Each event is described by note data indicative of the performance event and time data indicative of a performance timing of the performance event. The time data indicative of the performance timing may be either clock information indicative of an absolute time measured from the beginning of a song for example, or indicative of duration information determining a relative time interval from an immediately preceding performance event to a succeeding performance event. An SMF (Standard MIDI File) is known as a standard file for transferring performance data between different music sequencers. The SMF represents a performance timing by use of the duration information. The following describes an example in which a performance timing is represented by use of the duration information.

Referring to FIG. 1, in process A of step S1, the song data 11 (namely MIDI data) is sequentially read from the data area, the read song data 11 is converted into a sound source parameter (PARM), and the sound source parameter is written to a P buffer (a parameter buffer). It should be noted that step S1 is executed when the P buffer has an unused area (or a free area), and step S1 writes the sound source parameter (PARM) to the P buffer in advance. This is performed before the actual event timing 13 comes as shown in FIG. 2. It should also be noted that the performance timing 13 is located two frames before a current time frame (for example, F) at which waveform data is actually reproduced. Namely, the performance timing 13 is located in frame F−2 in manner similar to the operation of the conventional music tone generating method shown in FIG. 14.

In case of a PCM sound source, the sound source parameter includes start and end addresses of the waveform data corresponding to a selected timbre and an envelope, for example. The above-mentioned duration information is converted into clock information or time data indicative of the performance timing 13 shown in FIG. 2. The sound source parameter added with this clock information is written to the P buffer. Generally, the sound source parameter must be written together with certain time information such as the duration information included in the song data 11. Anyway, the sound source parameter is written along with the time information indicative of the performance timing such as clock information or time interval information. The resultant sound source parameter is used to identify the performance timing of each note event in waveform generation.

Process B of step S2 is executed upon completion of waveform reproduction in one time frame. Process B is activated at starting of each of the time frames as shown in FIG. 2. In the present embodiment, every time the reproduction in one time frame ends, waveform data to be reproduced two frames after the current frame is generated. For example, when the time frame F−2 ends, waveform data assigned to the time frame F is generated. If the clock information given to the sound source parameter falls within the time frame in which that waveform data is to be generated, this sound source parameter must be written to a sound source register in middle of the generation of the waveform data. For example, in the time frame (F−1) immediately preceding the time frame (F) for waveform data reproduction, the sound source parameter attached with the time information of that time frame (F) is inputted in the sound source register to be used for the music tone generation.

Next, in this time frame (F−1), waveform data (WAVE) is generated by use of the sound source parameter stored in the sound source register, and the generated waveform data is written to a W (Waveform) buffer. Execution of step S2 eliminates the necessity for storing the used sound source parameter in the P buffer. The area in which the used sound source parameter has been stored is therefore freed to provide an unused area (or a free area) in the P buffer.

In step S3, a reproducing device performs the reproduction processing. The reproducing device is constituted by a CODEC device, a CODEC driver and a sound system. The CODEC device herein denotes an LSI chip for audio interface containing an A/D converter, a D/A converter, a sampling frequency generator, a waveform compression/decompression circuit, and a DMAC (Direct Access Memory Controller). Although this LSI chip has capabilities of analog-to-digital and digital-to-analog conversion, waveform data cannot be recorded or reproduced by these capabilities alone. The CODEC driver is software that controls or uses the CODEC device under the control of the software sound source to record an input waveform into a RAM or to reproduce the waveform data stored in the RAM. It should be noted that the CODEC driver possibly uses a DMAC provided externally to the LSI chip. In such a case, this DMAC is also included in the reproducing device.

A program for generating waveform data passes the generated waveform data to the CODEC driver, thereby committing the waveform reproduction processing using the CODEC device, namely the processing for transferring the waveform data to the D/A converter sample by sample in every sampling cycle. The DMAC controlled by the CODEC driver reads the waveform data from the W buffer sample by sample in every sampling cycle, and outputs the read waveform data through the sound system.

For example, the CODEC driver has two buffer memories of one frame each for a DMA buffer. While the CODEC driver is reproducing the waveform data stored in one of these buffer memories, one frame of the waveform buffer is written from the W buffer to the other buffer memory. When the waveform data have all been reproduced from the former buffer memory, the CODEC driver takes to the reproduction of the waveform data stored in the latter buffer memory. During this reproduction, the waveform data stored in the W buffer is written to the former buffer memory. Repetition of these operations continuously reproduces the waveform data in the CODEC device. It should be noted that, instead of the two buffer memories provided by the CODEC driver, the above-mentioned W buffer may be provided in two units from which the waveform data are alternately reproduced. In this case, while the CODEC driver is reproducing the waveform data from one of the W buffers, the process B may generate the waveform data to be reproduced next and stores the waveform data in the other W buffer.

In step S1, sounding allocation may also be made. To make the sounding allocation in this stage, the CPU must determine which channel is in use for sounding at a note-on event. At a note-off event, the CPU may only find a channel being sounded corresponding to pitch data of the note-off event to write the note-off event to the sound source register of the found channel.

In the above-mentioned embodiment, the processing for generating waveform data from song data is divided into the process B in which the processing is performed according to the progression of the reproduction of the waveform data and the process A which can be performed independently of the process B. Linkage between the process A and the process B is implemented by adding time information to the sounding source parameter by use of time data which is duration information included in the song data. Since the waveform data generation from song data is divided into the process A and the process B, the process A can be performed in advance as far as the storage capacity of the P buffer allows such an advance computation, thereby temporally leveling the work load of the CPU in the waveform synthesis from the song data.

The P buffer may not have a storage capacity larger than necessary. The optimum capacity size of the P buffer is determined by the CPU throughput and other conditions, so that the storage capacity to be allocated to the P buffer may be automatically set by identifying the type of the CPU. Alternatively, the user may set the storage capacity as desired.

So far, the processing from reading of the song data to reproducing of the waveform data has been described along the flow of the processing. Actually, the reproduction of the waveform data by the CODEC is the main process, and therefore is given the highest priority. According to the waveform data reproduction, the waveform data generation of the process B is performed as subordinate processing.

As described, the inventive method produces musical tones according to song data basically by the steps S1 through S3 of FIG. 1. Namely, the first step S1 converts the song data sequentially into control parameters of the software sound source. The control parameters are written into a parameter memory provided in the form of the P buffer. Then, the second step S2 generates waveform data by using the control parameters written in the parameter memory. The generated waveform data are written into a waveform memory provided in the form of the W buffer, while the used control parameters are erased from the parameter memory to provide a vacant or free area. Lastly, the third step S3 reads the waveform data sequentially from the waveform memory to produce the musical tones. Characterizingly, the step S2 of generating waveform data is executed dependently on progression of the step S3 of reading the waveform data. Further, the step S1 of converting the song data is executed independently from progression of the step S2 of generating waveform data as long as the parameter memory has the vacant area sufficient to store the control parameters converted from the song data.

The inventive method may further comprise the steps of receiving a stream of the song data from an external data source, and writing the received stream of the song data successively into a song memory. In such a case, the step S1 of converting the song data can be commenced by retrieving the song data from the song memory without awaiting completion of writing the stream of the song data into the song memory.

Preferably, The inventive method further comprises the step of providing the song data in the form of a sequence of event data for specifying a musical tone to be produced and time data for determining an event time at which the specified musical tone is produced. In such a case, the step S1 of converting the song data comprises sequentially converting the event data into the control parameters effective to characterize the specified musical tone in advance of the event time of the specified musical tone. Further, the step S2 of generating waveform data comprises generating waveform data of the specified musical tone by using the control parameters written in the parameter memory before the event time of the specified musical tone so that the specified musical tone can be timely produced at the event time according to the waveform data generated before the event time.

Preferably, as shown in FIG. 2, the step S1 of converting the song data 11 comprises converting the event data into the control parameters 12 added with the time data in a preceding time frame (for example, F−5) allotted before the event time of the specified musical tone. The step S2 of generating waveform data comprises generating waveform data 14 of the specified musical tone by using the control parameters 12 selected according to the added time data in a succeeding time frame (for example, F−2) allotted still before the event time of the specified musical tone in a target time frame F.

The step S1 of converting the song data may convert the event data in the succeeding time frame while interrupting the step S2 of generating waveform when the step S1 of converting the song data has failed to convert the event data in the preceding time frame.

The step S2 of generating waveform data may comprise executing a computer program by means of a processor and a register to compute the waveform data according to the control parameters transferred from the parameter memory to the register.

The step S3 of reading the waveform data may comprise reading the waveform data sequentially one frame after another frame from the waveform memory to produce the musical tones timely at each frame. In such a case, the step S2 of generating waveform data is triggered to start generation of waveform data for another frame when the step of reading the waveform data starts reading of one frame of the waveform data.

Figure 3:
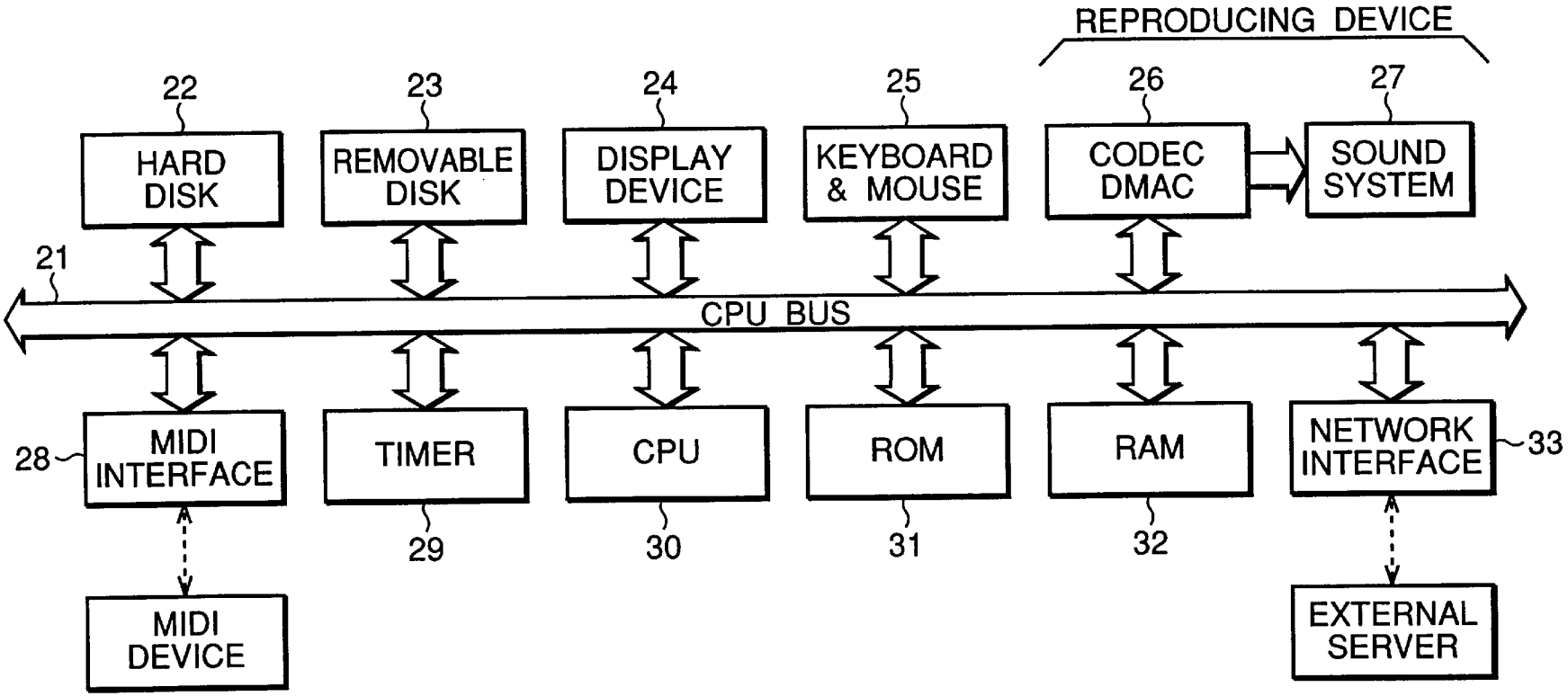
FIG. 3 is a block diagram illustrating hardware constitution of a personal computer having a music tone generating capability.

FIG. 3 is a block diagram illustrating hardware constitution of a personal computer having a music tone generating capability. Reference numeral 21 denotes a CPU bus, reference numeral 22 denotes a hard disk, reference numeral 23 denotes a removable disk such as a floppy disk, CD-ROM or a magneto-optical disk, reference numeral 24 denotes a display device such as a CRT or an LCD, reference numeral 25 denotes a keyboard and a mouse, reference numeral 26 denotes a CODEC, reference numeral 27 denotes a sound system, reference numeral 28 denotes s MIDI interface, reference numeral 29 denotes a timer, reference numeral 30 denotes a CPU, reference numeral 31 denotes a ROM, reference numeral 32 denotes a RAM, and reference numeral 33 denotes a network interface. This hardware constitution is shared by the first preferred embodiment shown in FIGS. 1 and 2, and a second preferred embodiment to be described later with reference to FIG. 10 and so on.

The above-mentioned hardware constitution is based on a normal personal computer plus the CODEC 26 and the sound system 27. If a CODEC driver having waveform reproducing capability is built in an operating system controlling the basic operation of this personal computer, a software sound source can be executed. A program for executing the software sound source is stored in the hard disk 22 for example and loaded into the RAM 32 for execution. Song data is stored in the removable disk 23 for example in advance, or supplied from an external server for example to be stored in the hard disk 22.

The P buffer and the W buffer shown in FIG. 1 are provided on the RAM 32. The CODEC 26 takes data from the RAM 32 through the internal or external DMAC. To connect this personal computer to an external MIDI device, the MIDI interface 28 is used. To connect this personal computer to the external server, the network interface 33 is required. In the present embodiment, the CPU 30 is a single CPU. However, multi-CPU constitution may be used depending on the operating condition.

As shown in FIG. 3, the inventive music apparatus has memories for producing musical tones according to song data. In the music apparatus, converting means is provided in the form of a software module executable by the CPU 30 for sequentially converting the song data into control parameters. Parameter writing means is also driven by the CPU 30 for writing the control parameters into a parameter memory provided in the RAM 32. Generating means is provided in the form of a software sound source module executable by the CPU 30 for generating waveform data by using the control parameters written in the parameter memory. Data writing means is also driven by the CPU 30 for writing the generated waveform data into a waveform memory provided in the RAM 32 while erasing the used control parameters from the parameter memory to provide a vacant area. Reading means is provided in the form of the CODEC/DMAC 26 for sequentially reading the waveform data from the waveform memory to produce the musical tones. Characterizingly, the generating means is executed dependently on progression of the reading of the waveform data, and the converting means is executed independently from progression of the generating of the waveform data as long as the parameter memory has the vacant area sufficient to store the control parameters converted from the song data.

The inventive music apparatus may further comprise receiving means composed of the network interface 33 for receiving a stream of the song data from an external data source, and song writing means for writing the received stream of the song data successively into a song memory provided in the RAM 32. In such a case, the converting means can commence converting by retrieving the song data from the song memory without awaiting completion of writing of the stream of the song data into the song memory.

The inventive music apparatus further comprises providing means such as the MIDI interface 28 for providing the song data in the form of a sequence of event data which specifies a musical tone to be produced and time data which determines an event time at which the specified musical tone is produced. In such a case, the converting means sequentially converts the event data into the control parameters effective to characterize the specified musical tone in advance of the event time of the specified musical tone, and the generating means generates waveform data of the specified musical tone by using the control parameters written in the parameter memory before the event time of the specified musical tone so that the specified musical tone can be timely produced at the event time according to the waveform data generated before the event time.

Preferably, the converting means converts the event data into the control parameters added with the time data in a preceding time frame allotted before the event time of the specified musical tone, and the generating means generates waveform data of the specified musical tone by using the control parameters selected according to the added time data in a succeeding time frame allotted still before the event time of the specified musical tone. Occasionally, the converting means may convert the event data in the succeeding time frame while interrupting the generating means when the converting means has failed to convert the event data in the preceding time frame.

Preferably, the generating means comprises a computer program executable by means of a processor constituted by the CPU 30 and a register provided in the RAM 32 to compute the waveform data according to the control parameters transferred from the parameter memory to the register.

Preferably, the reading means sequentially reads the waveform data one frame after another frame from the waveform memory to produce the musical tones timely at each frame. In such a case, the generating means is triggered to start generation of waveform data for another frame dependently when the reading means starts reading of one frame of the waveform data.

Further, a machine readable medium is provided in the form of the removable disk 23 used in the inventive music apparatus having the CPU 30 for producing musical tones according to song data. The medium contains program instructions executable by the CPU 30 for causing the music apparatus to perform the steps of converting the song data sequentially into control parameters, writing the control parameters into a parameter memory, generating waveform data by using the control parameters written in the parameter memory, writing the generated waveform data into a waveform memory while erasing the used control parameters from the parameter memory to provide a vacant area, and reading the waveform data sequentially from the waveform memory to produce the musical tones. Characterizingly, the step of generating waveform data is executed dependently on progression of the step of reading the waveform data, and the step of converting the song data is executed independently from progression of the step of generating waveform data as long as the parameter memory has the vacant area sufficient to store the control parameters converted from the song data.

Figure 4:
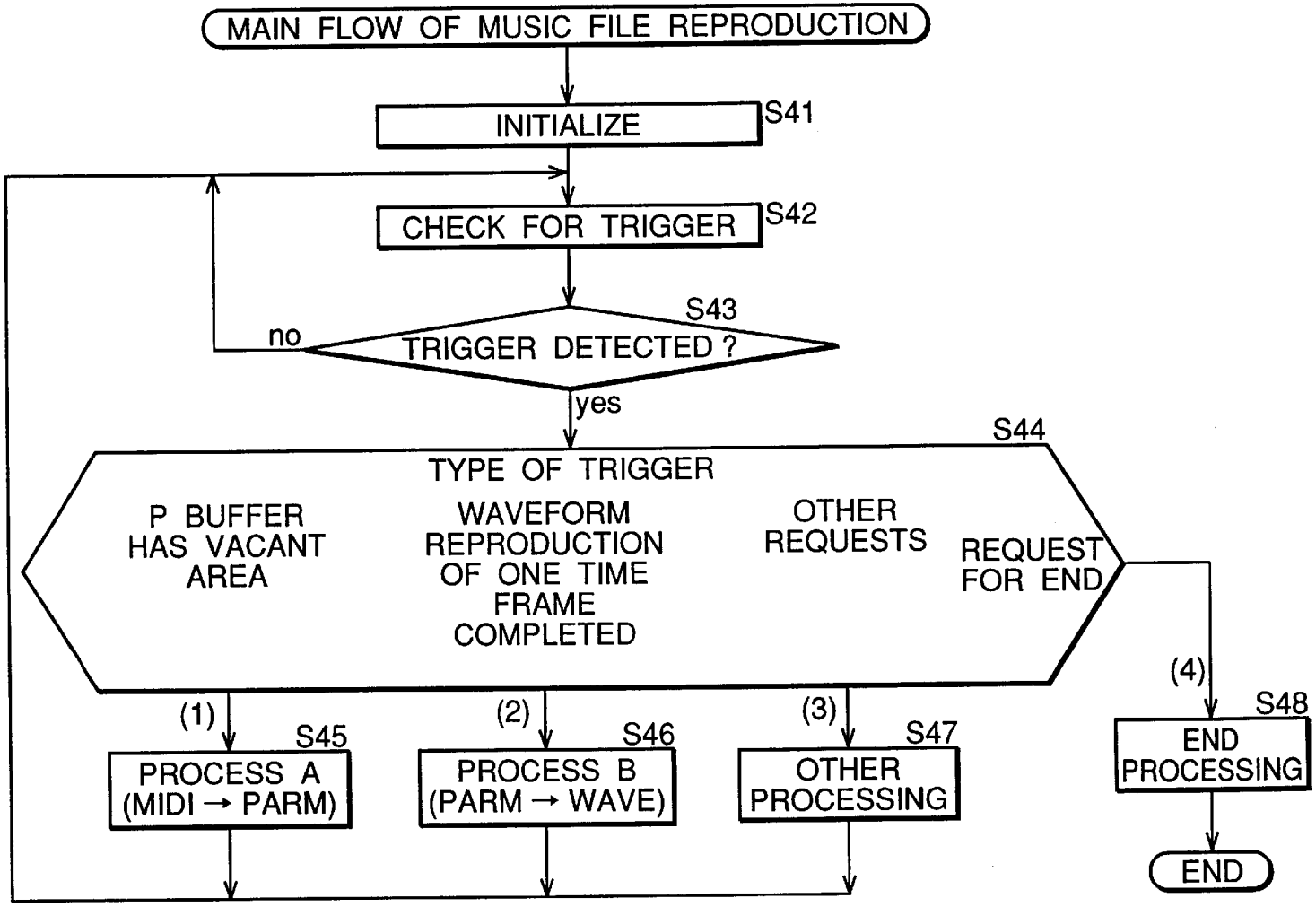
FIG. 4 is a main flowchart for describing the first preferred embodiment.

FIG. 4 is a main flowchart for describing the music tone generating method practiced as the first preferred embodiment of the invention. This processing flow is started by the software sound source program when the MIDI file name of a desired song is selected on the display device. In step S41, the sound source registers for all sounding channels are put in the note-off state. Then, for reproduction by the software sound source, the reproducing devices such as CODEC driver, CODEC 26, and the sound system 27 are initialized and the waveform reproducing software is started. In step S42, trigger check is performed. If no trigger is found in step S43, the processing returns to step S42. If a trigger is found, the processing goes to step S44, in which the trigger is analyzed.

In the trigger analysis in step S44, the processing goes to the process A of step S45 if (1) there is an unused area (or a free area) having a size larger than a predetermined level in the P buffer, MIDI data to be processed next is taken from the song data, the MIDI data is converted into a sound source parameter (PARM), and the sound source parameter is written to the P buffer; if (2) waveform reproduction of one time frame has been completed, the processing goes to the process B of step S46, in which a waveform of the next time frame is generated based on the sound source parameter having performance timing information stored in the P buffer, and the generated waveform is written to the W buffer; if (3) another request such as a timbre selecting operation or an algorithm selecting operation comes, the processing goes to step S47, in which setting of the sound source is performed; and if (4) a software sound source end request comes, the processing goes to step S48, in which the software sound source program is ended. The CPU 30 shown in FIG. 3 always monitors these triggers and determines the detected trigger in step S44, thereby starting the corresponding processing.

Most important of all is the process B for waveform generation. Timbre change halfway for example does not present a serious problem in processing delay in the auditory sense. Considering these points, the priority is given in the above-mentioned multitask processing to the processing (2), the processing (1), the processing (3), and the processing (4) in this order. It should be noted that, in the P buffer and the W buffer, the areas in which the data used for processing has been stored are freed again as unused areas.

The following describes a variation to the above-mentioned trigger (2) of the process B. In the above description, the trigger is provided when the waveform reproduction of one time frame has been completed. In the variation, attention is paid to the buffer area of the CODEC device to be read by the CODEC driver. When this buffer area is freed to some extent to provide an unused area of a size larger than a predetermined level, the trigger (2) for the process B may be provided. Alternatively, a waveform generating trigger for causing an intermediate-level interrupt may be frequently issued at a time interval smaller than one time frame. When the interrupt is successful, it provides the trigger (2) of the process B, thereby recovering the delay in waveform generation if unsuccessful waveform generation has occurred before. Thus, this variation makes the sound source operate with stability under circumstance in which interrupts are made often in a fluctuating manner. It should be noted that the buffer of the CODEC is normally composed of two frames; however, a larger buffer size may be used. In any variation, in the process B started by the trigger (2), a waveform of a predetermined quantity according to the size of the unused area in the buffer of the CODEC at that point of time may be generated. In the above-mentioned trigger variation, the W buffer is not necessarily required.

Figure 5:
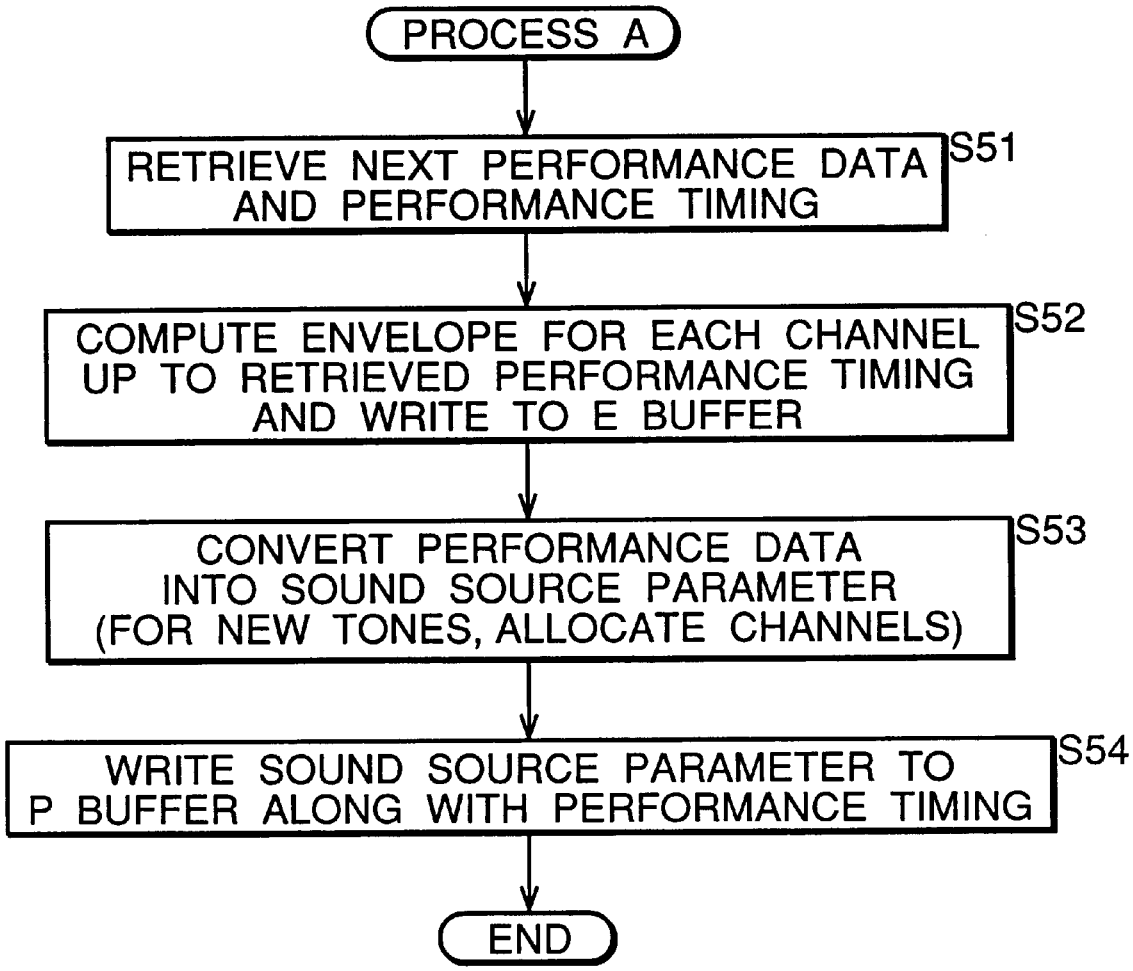
FIG. 5 is a flowchart of process A shown in FIG. 4.

FIG. 5 is a flowchart of the process A shown in FIG. 4. In step S51, performance data and performance timing of a next performance event are taken from song data. To be more specific, the performance event already read from the song data is pointed by the pointer to take out the next performance event. The performance data is MIDI data. The performance timing is the duration information included in the MIDI data or the clock information obtained from the duration information.

In step S52, an envelope level in each channel (ch) is computed up to this performance timing and the obtained envelope is written to an E (Envelope) buffer. The E buffer is different from any of the P buffer and the W buffer shown in FIG. 1. Conventional hardware sound sources have an envelope reading capability, and sound channel allocation is performed by checking the level of the envelope of each sounding channel. Use of the routine for this process on a software sound source requires to generate the envelope first. Even if no performance event is newly occurring, the envelope level is required during sounding of existing tones. Therefore, the level of one envelope is generated for one time frame and the generated level is stored in the E buffer, for example. Then, the actual level of the envelope within that time frame is generated by interpolation.

In step S53, the performance data is converted into a sound source parameter and, for new tones, sounding allocation is performed based on the above-mentioned envelope level. In step S54, this sound source parameter is written to the P buffer along with above-mentioned performance timing.

It should be noted that step S52 may be deleted, in which the envelope is not generated at converting the performance data into a parameter. In this case, at the stage of sound source parameter generation, sounding channel allocation is not performed, which will be performed at the waveform generation of the process B to be described later. In this case, however, if two or more performance events occur simultaneously, the processing load increases, so that the sounding channel allocation is preferably performed at the stage of sound source parameter generation. Alternatively, when performing sounding channel allocation at the stage of sound source parameter generation, sounding allocation may be performed on a last-in first-served basis without using envelope level. Namely, tone sounding inputted last may be processed first.

Figure 6:
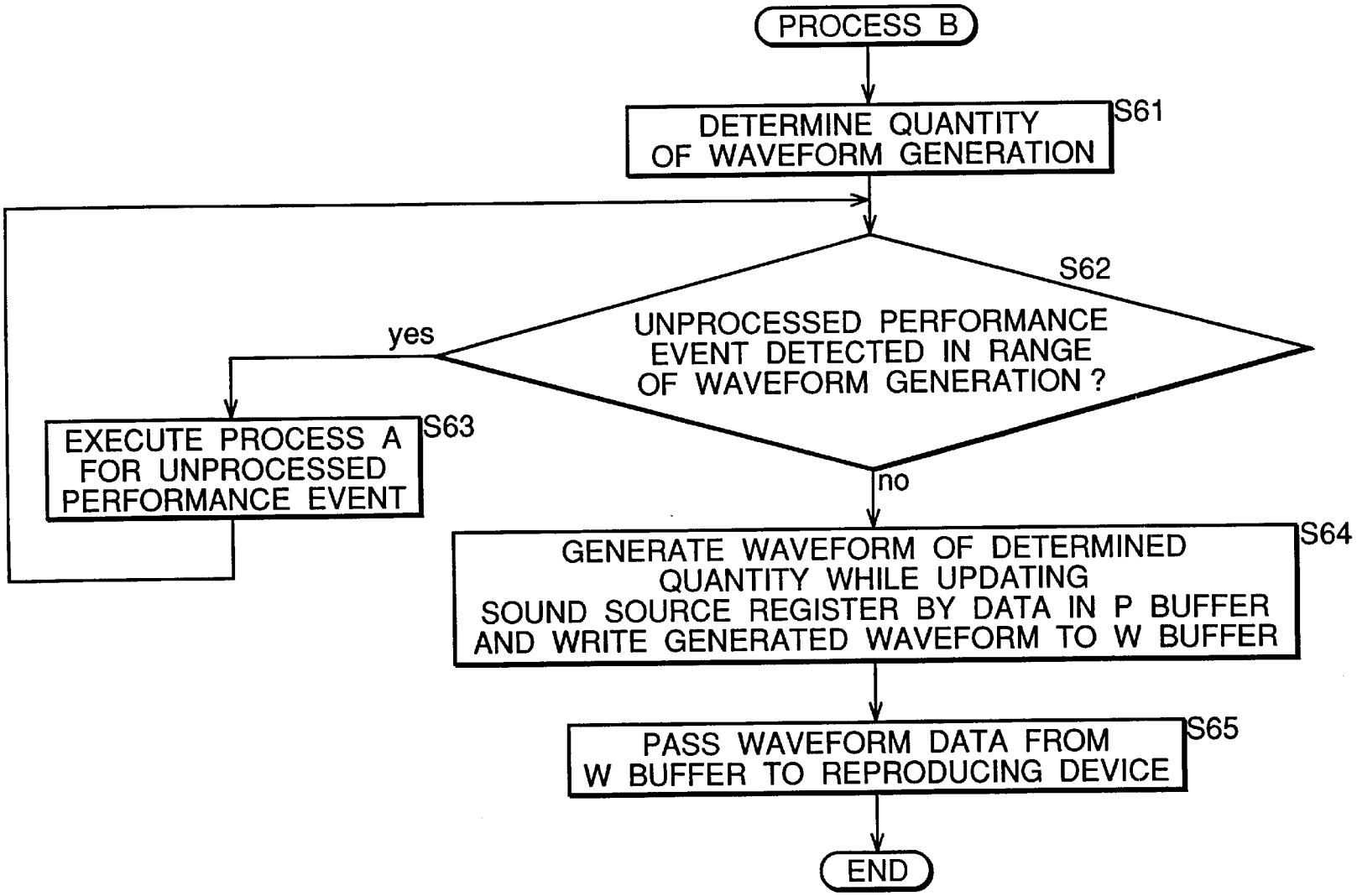
FIG. 6 is a flowchart of process B shown in FIG. 4.

FIG. 6 is a flowchart of the process B shown in FIG. 4. The process B is started when generating a waveform. In step S61, a waveform generating quantity is determined. As shown in FIG. 2, when an interrupt is caused in each time frame, this waveform generating quantity is fixed to one frame. In the variation of the trigger (2) described above with reference to FIG. 4, the waveform generating quantity is determined according to the size of the unused area in the CODEC buffer.

In step S62, it is determined whether there is an unprocessed performance event in the range in which a waveform is generated. In this determination, the pointer indicating the performance event for which the process A has been executed after this performance event was already read from the song data is checked to see whether the performance timing of the next performance event is after the range in which waveform generation is performed. Generally, an interval at which the performance event occurs is long relative to the time frame of several ms to several tens ms, so that the performance event in the range in which waveform generation is to be performed should have ended the process A in advance. Possibly, however, the song data still has, in this range, a performance event that has not ended the process A.

Figure 7:
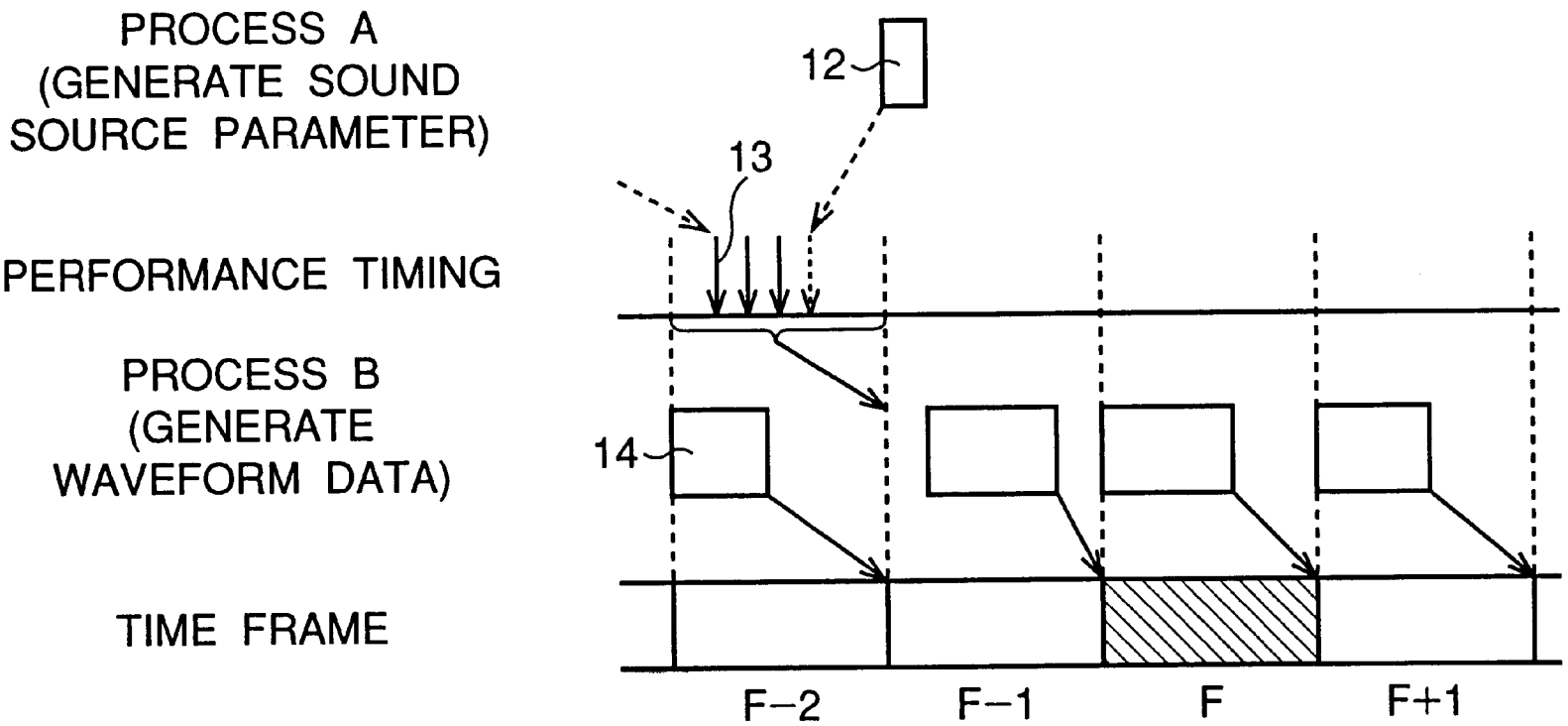
FIG. 7 is a timing chart for describing a variation of the first embodiment.

FIG. 7 is a timing chart of a first example in which there is an unprocessed event in the range in which waveform generation is performed. In the figure, portions similar to those previously described with reference to FIGS. 14 and 2 are denoted by the same references for simplicity of description. As shown in FIG. 7, if it is determined in the time frame (F−1) that there remains a performance event of which waveform reproduction is required in the time frame (F), the processing goes to step S63 of FIG. 6. In step S63, the process A of the unprocessed performance event is executed in the sound source parameter generating period 12 in the time frame (F−1), upon which the processing returns to step S62. In step S62, if there is no more unprocessed performance event in the range of waveform generation, the processing goes to step S64. Step S63 may be repeated as required.

In step S64, if the performance timing of the sound source parameter stored in the P buffer enters the time frame in which waveform generation is to be performed, the waveform data is generated by updating the sound source register by the sound source parameter stored in the P buffer at a time at which a waveform data generation position matches this performance timing halfway through the generation of one frame of waveform data, based on the sound source parameter stored in this sound source register. For example, in the case of a note-on event, the sound source parameter necessary for sounding is transferred to one channel of the sound source register, and the register indicating note-on/note-off is turned on to establish the note-on status. In the case of a note-off event, the register indicating note-on/note-off is simply turned off. Subsequently, based on the sound source parameter stored in the sound source register, one frame of waveforms is generated to be put in the W buffer.

In waveform generation, the envelope written to the E buffer in step S52 of the process A shown in FIG. 5 is also used. If no envelope is generated in step S52 of the process A shown in FIG. 5, waveform generation is performed here while performing envelope generation. In step S62, although it has been found that the waveform generating range has no unprocessed performance event, the envelope of the performance event included in the waveform generating time frame may not have been generated in the E buffer. In other words, of the envelope waveforms necessary for waveform data generation, the envelope has already been generated by the process A up to the processed final event, but no envelope has been generated for the time frame subsequent to the final event. The interpolation cannot generate the envelope of the performance event included in this time frame. In such a case, it is necessary in step S64 to generate the envelope for the time frame in which the waveform data is generated. In step S65, one frame of the waveform data generated and written to the W buffer is passed to the CODEC driver.

The following describes a variation to the processing of step S62. In step S62, it is determined whether at least one performance event subsequent to the time frame in which waveform generation is to be performed has already been processed or not. If that performance event is found not yet processed, the processing goes to step S63, in which at least one performance event is processed, upon which the processing goes to step S64. In this processing flow, the envelope is generated by the process A up to the performance event 13 subsequent to the time frame in which waveform generation is to be performed, making it unnecessary to perform envelope generation in step S64.

Figure 8:
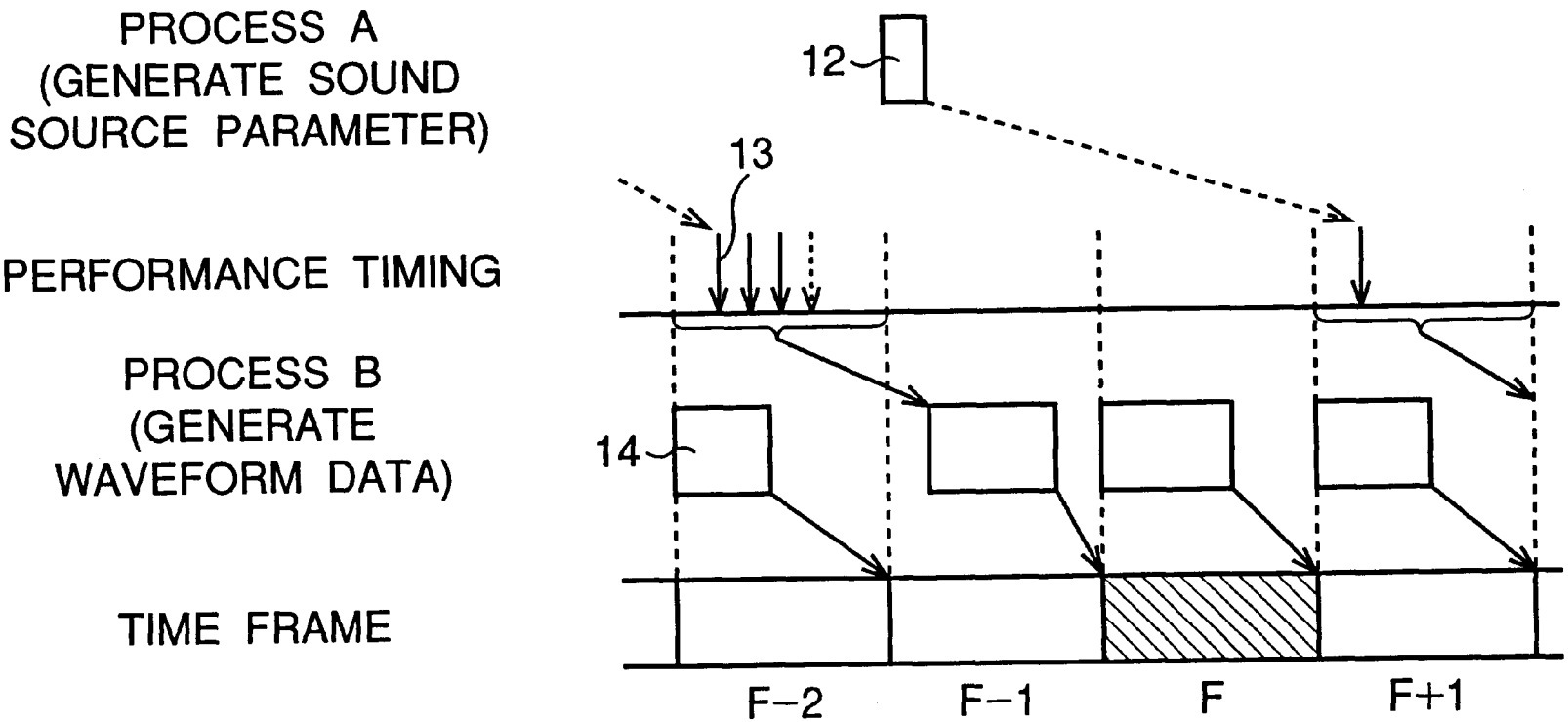
FIG. 8 is a timing chart for describing another variation of the first embodiment.

FIG. 8 shows a timing chart of a second example in which there is an unprocessed event in the range of waveform generation. In the figure, portions similar to those previously described with reference to FIGS. 14 and 2 are denoted by the same references for simplicity of description. As shown in FIG. 8, if it is determined that an unprocessed performance event not converted into a sound source parameter in the time frame (F−1) is to provide waveform generation in the time frame (F+2) for example subsequent to the range of the time frame (F) in which waveform generation is performed, the processing goes from step S62 to S64 shown in FIG. 6. On the other hand, in the above-mentioned variation to the processing of step S62, the processing goes to step S63 to convert the song data of this unprocessed performance event into a sound source parameter, upon which the process B is executed. Thus, the waveform processing can be performed after execution of the process A of the performance event having the performance timing after the range in which waveform generation is performed.

Figure 9:
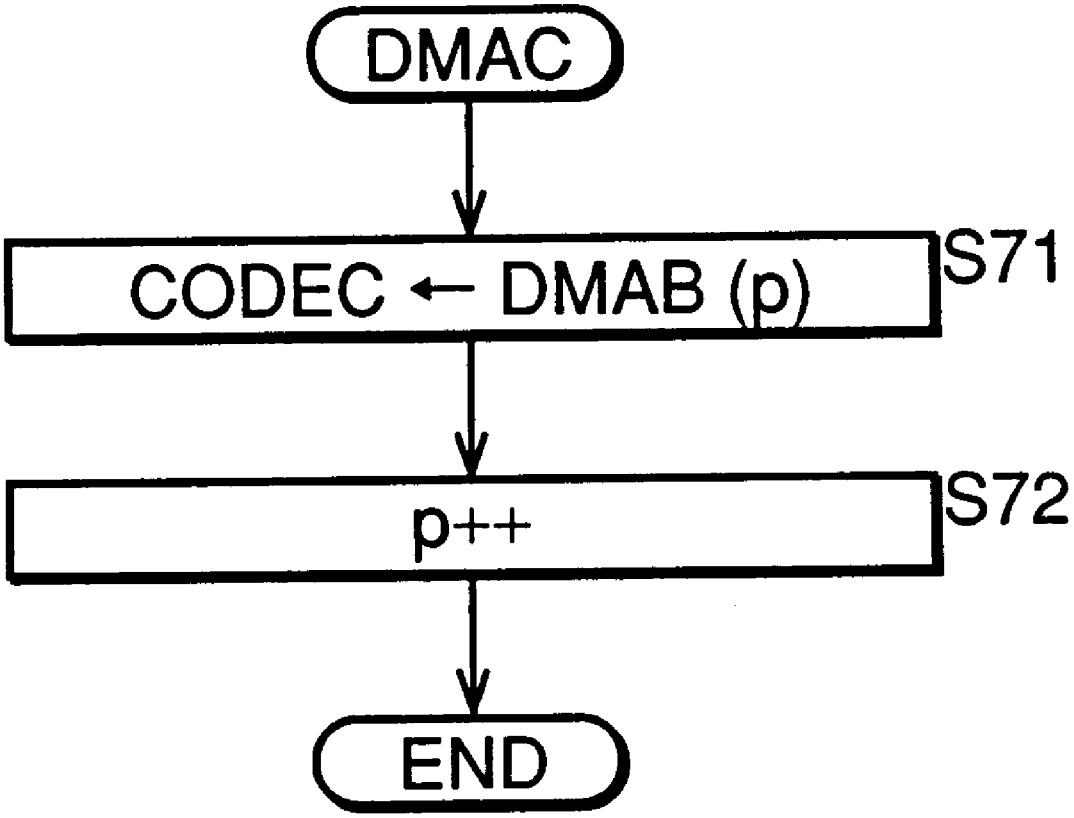
FIG. 9 is a flowchart for describing DMAC operation.

FIG. 9 is a flowchart of the DMAC. This flowchart indicates the processing of the waveform reproducing program by the CODEC. In step S71, the DMA buffer (DMAB), which is the wave buffer of the CODEC, sends waveform data sample by sample to the CODEC according to a sample request interrupt (a hardware interrupt) caused by the CODEC in the sampling period. In step S72, the transfer sample count p is incremented by one to repeat the processing of step S71. The transfer sample count p is expressed in 8 bits for example and, when the count reaches 225, returns to 0. The CODEC counts the transfer sample count p and regards that waveform reproduction of one frame has been completed every time the number of samples equivalent to a half of the DMA buffer size are transferred, namely the transfer sample count p=127 and p=255, thereby executing the hardware interrupt. This hardware interrupt provides the trigger for starting the process B, or the trigger (2) in step S44 shown in FIG. 4. In the waveform generation processing of the process B, one frame of the samples equivalent to a half of the DMA buffer size are collectively generated at a time in the W buffer, and the waveform data in the W buffer is transferred to the DMA buffer. The above-mentioned DMA buffer size is equivalent to two time frames. The DMA buffer size can be changed as desired by changing the address setting of the DMA controller (DMAC).

Figure 10:
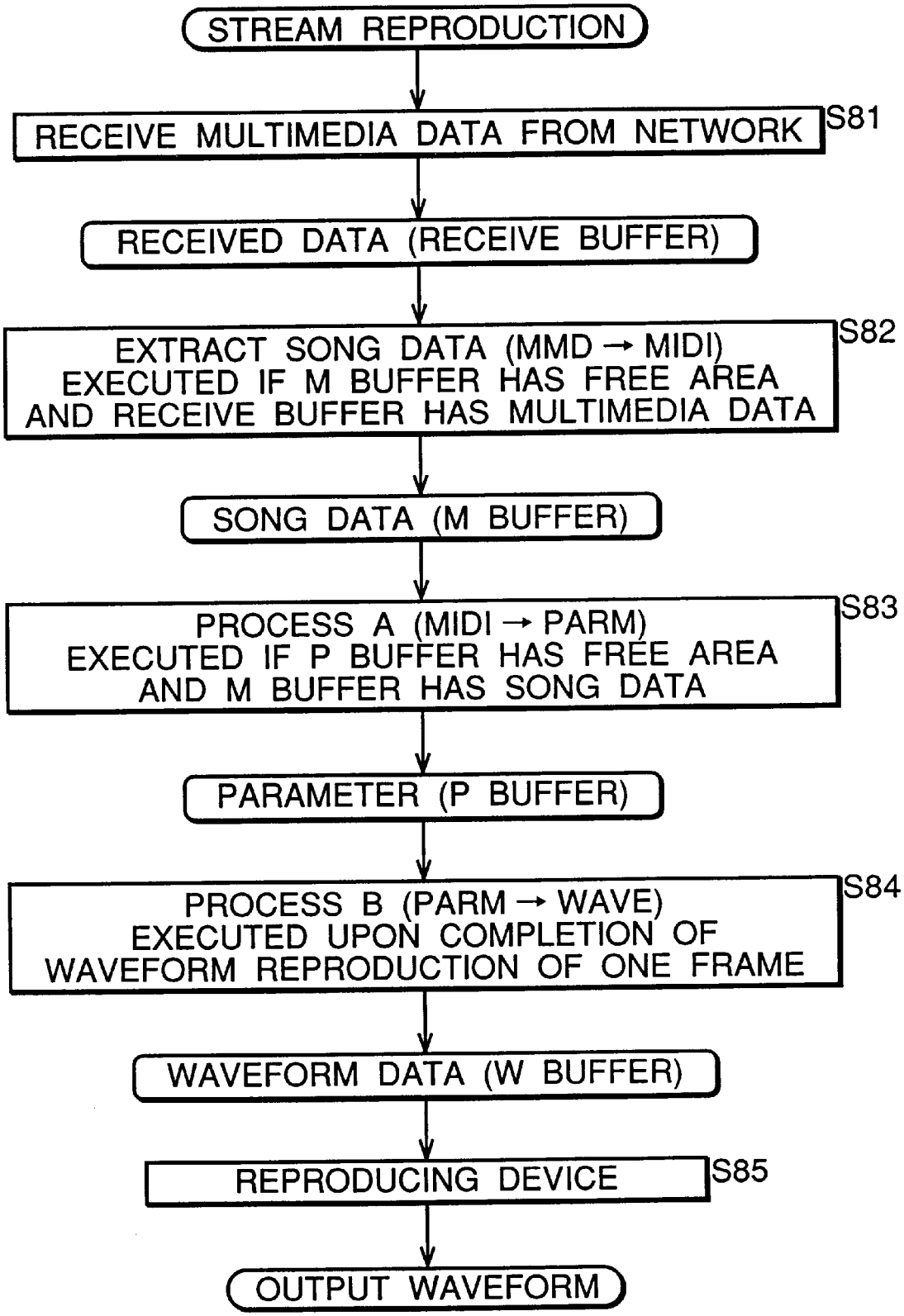
FIG. 10 is a diagram illustrating a flow of process by a music tone generating method practiced as a second preferred embodiment of the present invention.

FIG. 10 is a diagram illustrating the processing flow of a music tone generating method practiced as a second preferred embodiment of the invention. This figure shows a case of the stream reproduction. In step S81, multimedia data (MMD) is received from a network, and the received MMD is written to the receive buffer provided in the RAM 32 shown in FIG. 3. The area for this receive buffer has a size enough for storing one piece of song of multimedia data for example. It should be noted that the multimedia data denotes data including MIDI data, lyric words data and image data that synchronize with the MIDI data.

In step S82, song data (MID) consisting of MIDI data is extracted from the multimedia data (MMD) read from the receive buffer, and the read song data is written to an M (MIDI) buffer. The extracted MIDI data also includes duration information indicative of the time interval of a performance event like the song data described with reference to FIG. 1. This duration data is converted into clock information data indicative of a performance timing, and the resultant song data (MIDI) is stored in the M buffer along with the MIDI data of the performance event. It should be noted that step S82 is executed if the M buffer has an unused area (a free area) and the receive buffer has unprocessed multimedia data (MMD).

The processing operations of step S83 and subsequent steps are generally the same as those of steps S1 through S3 for the song file reproduction shown in FIG. 1. There are some differences yet. The process A of step S83 is executed if the P buffer has an unused area and the M buffer has song data (MIDI). When this step is executed, the used song data need not be stored in the M buffer. The area in which the used sound source parameter has been stored is freed, thereby providing an unused area in the M buffer. Step S84 differs from the corresponding step shown in FIG. 1 in the processing in which there is an unprocessed performance event in the range of waveform generation as will be described with reference to FIG. 13. Like the sound source parameter generated in step S1 shown in FIG. 1, the sound source parameter generated in step S83 has time information indicative of a performance timing.

In the above-mentioned second preferred embodiment, the total processing for generating the waveform data from the received data is divided into process B performed according to the progression of waveform data reproduction and process A capable of performing the processing independently of the waveform data generation. The linkage between the process A and the process B is implemented, to be specific, by adding time information also to the song data (MIDI) and the sound source parameter (PARM) by using time data, or the duration information included in the song data (MID) in the received multimedia data (MMD). Because the process B is thus separated from the song data extraction process and the process A, the song data extraction process and the parameter conversion processing can be executed in advance in the range of the storage capacities of the M and P buffers, thereby temporally leveling the load of reproducing the waveform data from the received data.

Moreover, if the song data is stored in the M buffer, the processing for converting the same into a parameter can be performed, so that the song can be reproduced without waiting until the song data is all loaded. If the storage size of the receive buffer is made large enough for allocating one song of multimedia data for example as described above, and the received multimedia data is kept unrewritten, the data remaining in the receive buffer can be reproduced again. Alternatively, using this receive buffer as a write buffer, the received multimedia data may be written without change to the hard disk 22 or the removable disk 23 shown in FIG. 3. Alternatively still, if the storage size of not the receive buffer but the M buffer is made large enough for keeping the song data unrewritten, only the song data may be reproduced again.

In this second embodiment, the inventive method produces musical tones according to song data by the steps S81 through S85 shown in FIG. 10. Initially, the step S81 receives a stream of the song data MIDI from an external data source through a communication line. The step S82 successively writes the received stream of the song data MIDI into a song memory provided in the form of the M buffer. The step S83 sequentially converts the song data MIDI stored in the song memory into control parameters PARM, and writes the control parameters PARM into a parameter memory provided in the form of the P buffer. The step of S84 generates waveform data WAVE by using the control parameters PARM written in the parameter memory, and writes the generated waveform data WAVE into a waveform memory provided in the form of the W buffer, while erasing the used control parameters PARM from the parameter memory to provide a vacant area. The step S85 reads the waveform data WAVE sequentially from the waveform memory to produce the musical tones. Characterizingly, the step S84 of generating waveform data is executed dependently on progression of the step S85 of reading the waveform data. Further, the step S83 of converting the song data is executed independently from progression of the step S84 of generating waveform data as long as the parameter memory has the vacant area sufficient to store the control parameters converted from the song data. Moreover, the step S83 of converting the song data can be commenced by retrieving the song data from the song memory without awaiting completion of writing the stream of the song data into the song memory.

Figure 11:
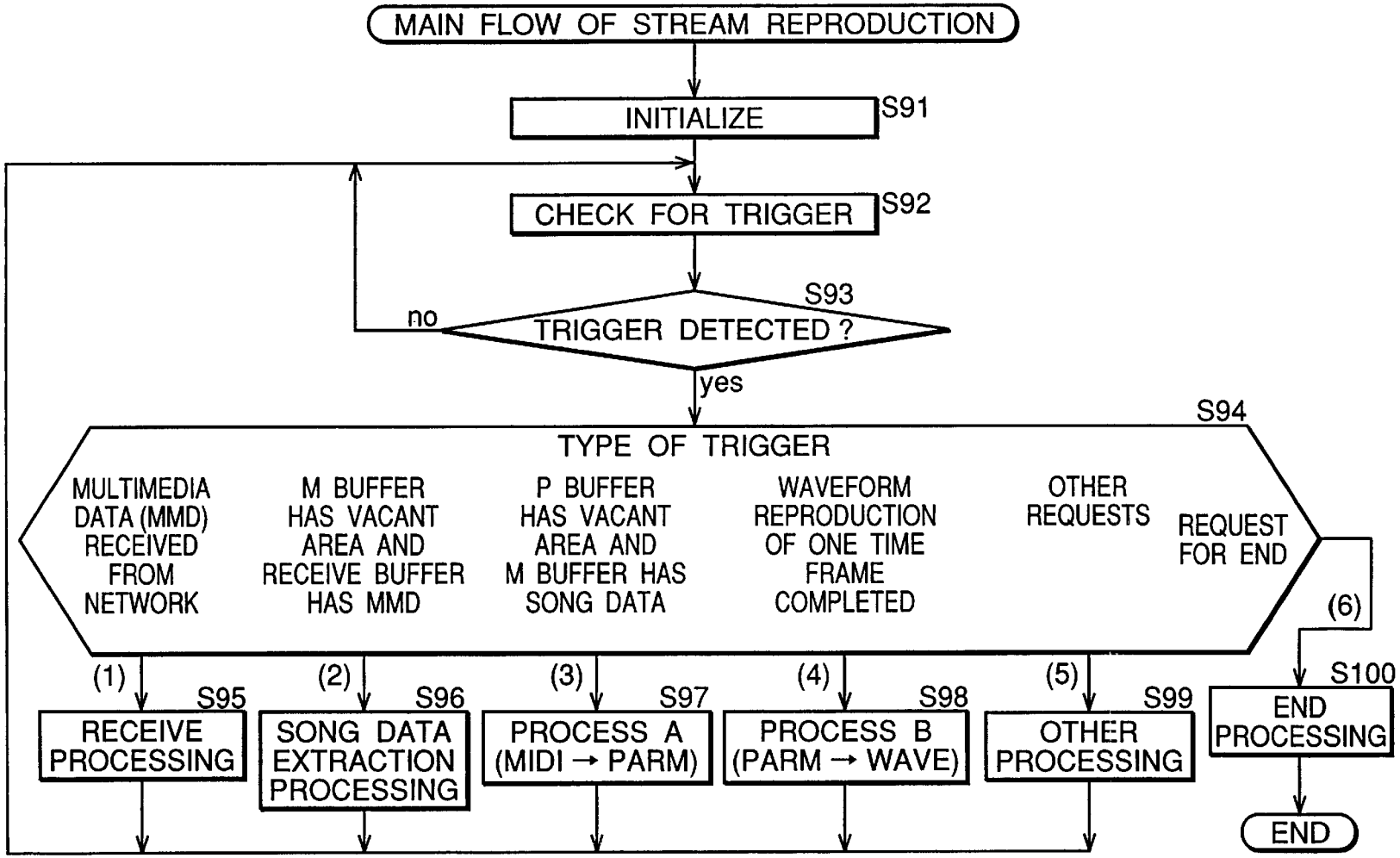
FIG. 11 is a main flowchart for describing the second preferred embodiment.

FIG. 11 is a main flowchart of the music tone generating method associated with the second preferred embodiment of the invention. A program for implementing this flow is implemented as plug-in software built in a Web browser for example. Tag data is embedded in a home page in the WWW, the tag data being indicative of a position in a server at which song data such as a standard MIDI file (SMF) or multimedia data (MMD) including such song data is stored. When downloading is instructed according to this tag data, this program is started to perform not only the downloading but also the processing up to the reproduction of the multimedia data.

In step S91, the sound source registers for all sounding channels are put in the note-off state and the CODEC is initialized to start the waveform reproducing software. In step S92, a trigger check operation is performed. If no trigger is found, the processing is returned to step S92; if a trigger is found, the processing goes to step S94 in which the detected trigger is analyzed.

In the trigger analysis of step S94, (1) if multimedia data (MMD) is received from the network, the processing goes to step S95, in which the receive processing is performed and the received multimedia data (MMD) is written to the receive buffer. (2) If the M buffer has an unused area (free area) and the receive buffer stores the multimedia data (MMD), the processing goes to step S96, in which the multimedia data (MMD) is read from the receive buffer to extract song data (MIDI). (3) If the P buffer has an unused area and the M buffer stores song data (MIDI), the processing goes to the process A of step S97, in which the song data (MIDI) to be processed next is taken from the M buffer, the taken song data is converted into a sound source parameter (PARM), and the same is written to the P buffer. (4) If the waveform reproduction of one time frame has been completed, the processing goes to the process B of step S98, and a waveform of the next time frame is generated based on the sound source parameter attached with performance timing information read from the P buffer. (5) If there is another request such as switching operation for timbre selection or multimedia processing operation such as replacement or scroll of words or image display, the processing goes to step S99, in which setting operation required by the request is performed. (6) If a request for ending the sound source software comes, the processing goes to step S100 in which the execution of the program of the software sound source is ended. The CPU 30 shown in FIG. 3 always monitors the above-mentioned triggers and, in step S94, determines the detected trigger to start the specific necessary processing.

When starting the downloading, the receive processing of (1) and the song data extraction processing of (2) are started first. Only when a predetermined quantity or a predetermined time length of multimedia data has been stored in the M buffer, the software sound source waveform generation processing of the process A in (3) and the process B in (4) are started. Alternatively, the above-mentioned waveform generation processing may be started after a predetermined quantity or a predetermined time of multimedia data has been stored in the receive buffer. Alternatively still, the process A of (3), along with the receive processing of (1) and the song data extraction processing of (2), may also be started before the process B of (4) and the process B of (4) may be started after a predetermined quantity or a predetermined time length of sound source parameters have been stored in the P buffer. Thus, the waveform generation is started after the data has been stored in each buffer to some extent, so that the operation immediately after starting the reproduction processing can be performed with stability. It should be noted that the above-mentioned predetermined quantity and the predetermined time length depend on the transfer rate of the network, the communication line quality, and other conditions, so that the predetermined quantity and time length may be set by the user appropriately. The multitask processing is performed in the order of the multimedia processing of (1), (4) and (5), the switching operations of (2), (3) and (5), and the processing of (6). In the M buffer, P buffer, and W buffer, the areas in which the data already used for the processing has been stored are freed to provide unused area.

Figure 12:
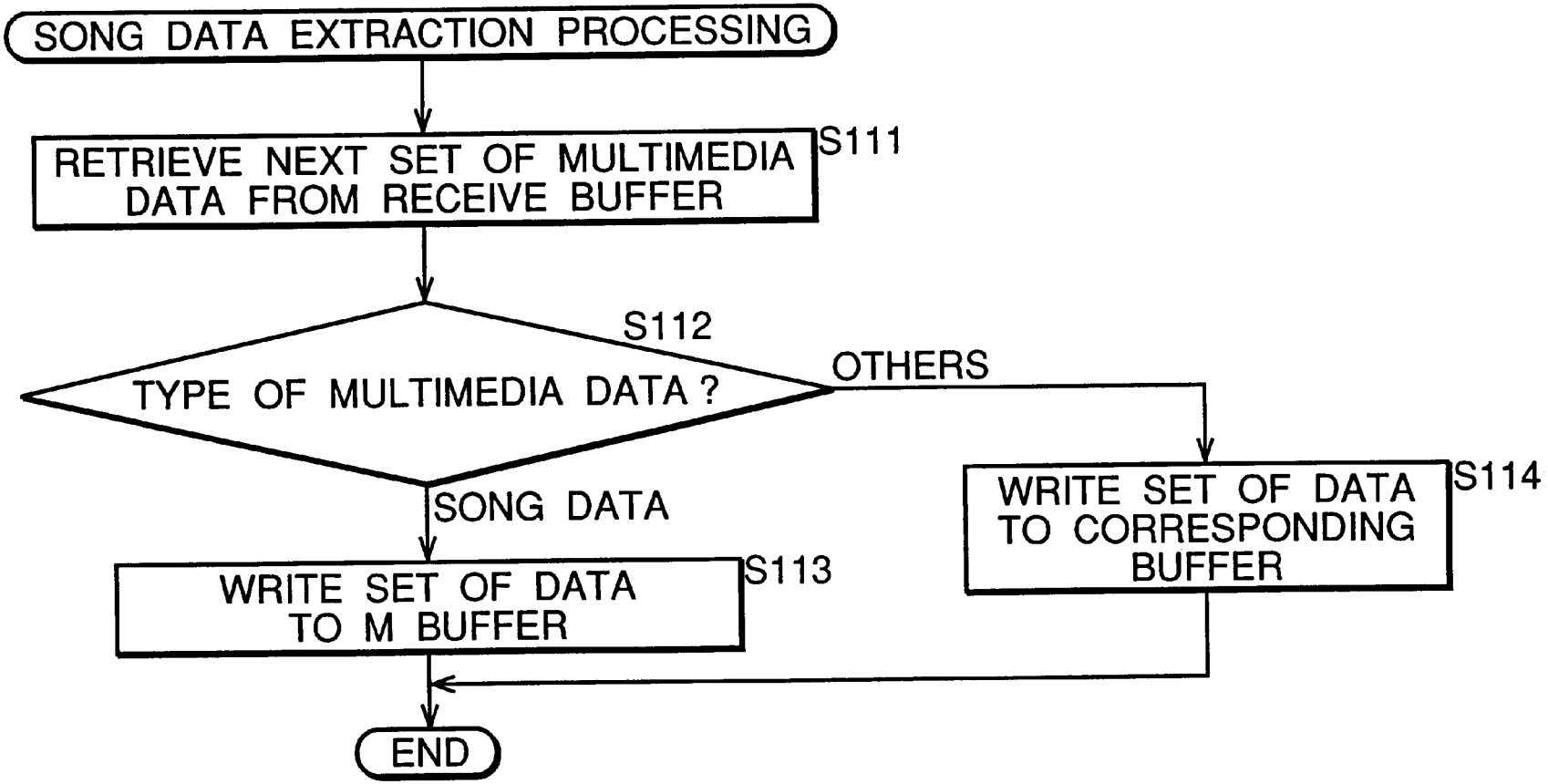
FIG. 12 is a flowchart of song data extraction processing shown in FIG. 11.

FIG. 12 is a flowchart of the song data extraction processing shown in FIG. 11. In step S111, a next set of multimedia data (MMD) is taken from the received buffer. In step S112, the type of the multimedia data is determined. If the multimedia data is song data (MIDI), the processing goes to step S113; otherwise, the processing goes to step S114. In step S113, this set of song data is written to the M buffer. In step S114, this set of multimedia data is written to a corresponding buffer; for example, image data is written to a G buffer and words data is written to a K buffer. The stored multimedia data is processed for display in the reproduction timing thereof by the processing of step S99 shown in FIG. 11 and other processing.

The words data and image data included in the multimedia data have clock information such as a time stamp or a time code indicative of a time at which words and image data are displayed. The words data and the image data are written to the corresponding buffers along with this clock information. In displaying words and images, this clock information and the timing of reproducing waveform data generated by the software sound source, namely the clock information indicative of a performance timing of a performance event, are used to facilitate reproduction of waveform data and correct synchronization between displaying of words data and displaying of image data. If the performance timing of the performance event is stored in the parameter buffer as time interval information attached with the sound source parameter, audio and video can be likewise synchronized with each other by always making the clock information available by accumulating this time interval information.

Figure 13:
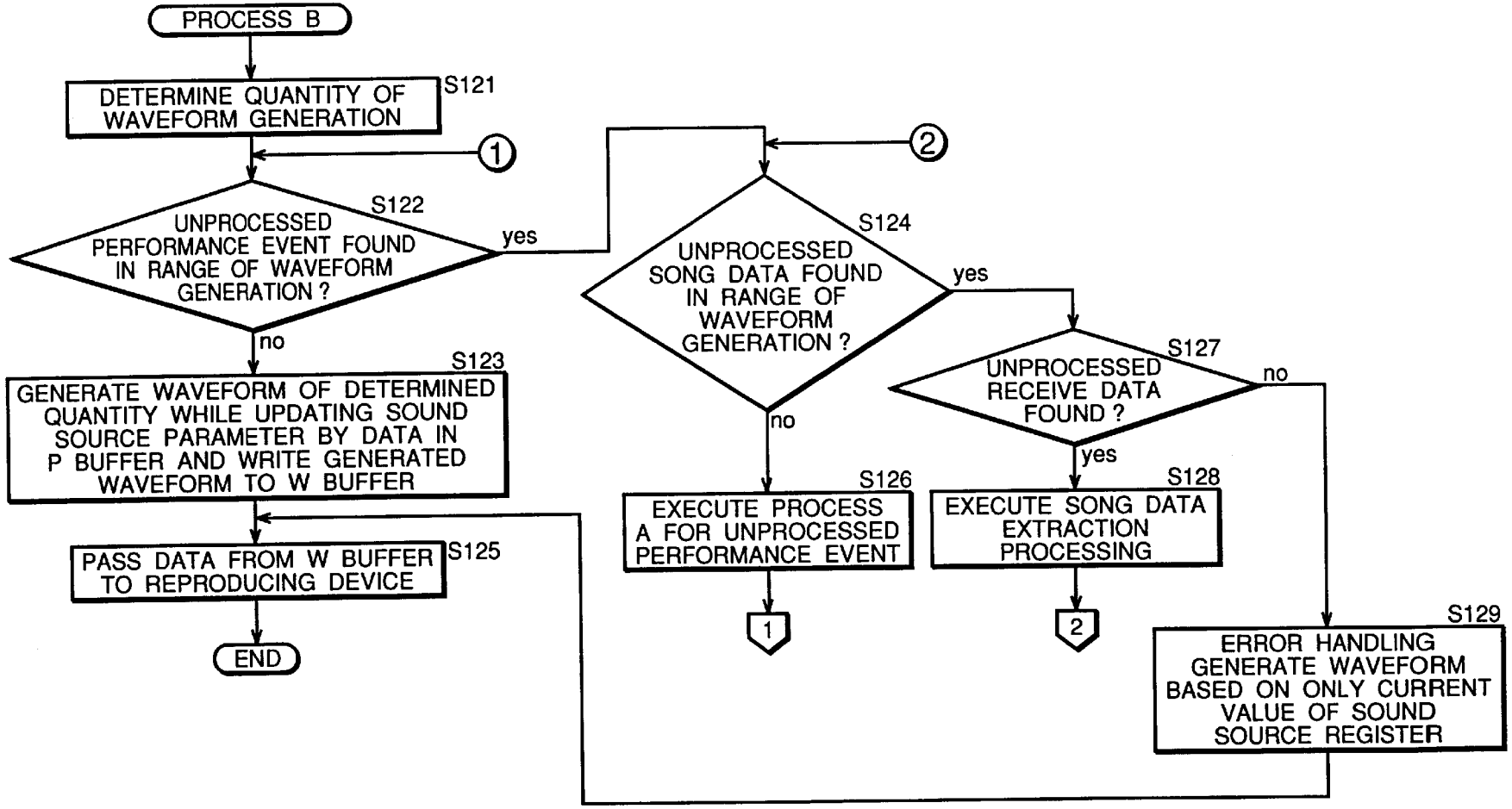
FIG. 13 is a flowchart of process B shown in FIG. 11.

FIG. 13 is a flowchart of the process B shown in FIG. 11. In step S121, a quantity of waveforms to be generated is determined. In step S122, the range in which waveform generation is performed is checked for an unprocessed performance event. In this processing, the pointer is checked indicative of a performance event already read from song data and for which the process A has been performed. In doing so, it is determined whether the performance timing of the next performance event is after the range in which waveform generation is to be performed. If no unprocessed performance event is found, the processing goes to step S123; if an unprocessed performance event is found, the processing goes to step S124.

In step S123, if the performance timing of the sound source parameter stored in the P buffer enters the time frame in which waveform generation is to be performed, while the sound source register is updated by the sound source parameter stored in the P buffer at a time when the position of generating one frame of waveform data matches this performance timing halfway through this generation, the waveform data is generated based on the sound source parameter stored in this sound source register. Then, one frame for example of the generated waveform data is written to the W buffer. In step S125, one frame of the waveform data written to the W buffer is transferred to the CODEC driver.

In step S124, processing to be performed if the sound source parameter necessary for waveform generation is not prepared is performed. In this step, it is determined whether unprocessed song data exists in the range in which waveform generation is to be performed. The pointer is checked indicative of the performance event already read from the received data and from which song data has been extracted. It is checked if the performance timing of the performance event next to the performance event indicated by this pointer is after the range in which waveform generation is to be performed. If no unprocessed song data is found, the processing goes to step S126; if an unprocessed song data is found, the processing goes to step S127. In step S126, the process A of the unprocessed performance event is performed, upon which the processing goes back to step S122.

In step S127, processing to be performed if the song data is not prepared is performed. It is determined whether the receive buffer has unprocessed received data by checking if the last received data for which song data extraction has been performed is the most recent received data. If the unprocessed received data is found, the processing goes to step S128; if the unprocessed received data is not found, the processing goes to step S129. In step S128, song data extraction processing is performed, upon which the processing goes back to step S124.

In step S129, error handling is performed since necessary received data has not yet come. In this error handling, waveform generation is performed based only on the current value of the sound source register and, in step S125, processing is performed such that an already sounding tone is continued. Alternatively, the already sounding tone may be damped gradually.

It should be noted that, for the processing of step S122, processing similar to the variation of step S62 in the process B in the case of song data reproduction shown in FIG. 6 may be performed. Namely, after executing without failing the process A for at least one of the performance events subsequent to the range of waveform generation, waveform data generation processing may be performed. Likewise, also in step S124, after executing without failing the song data extraction processing for at least one of the performance events of a performance timing subsequent to the range of waveform generation, the processing may be changed to parameter conversion and waveform data generation processing. In this modification, like the waveform generation of step S64 in the process B in the case of song data reproduction shown in FIG. 6, it is assured that envelope generation has been ended in the process A for the time frame in which waveform generation is performed this time, so that no envelope need be generated in step S123. Conversely, if the processing of step S122 is not changed, envelope generation is sometimes required in step S123.

The second preferred embodiment of the invention described with reference to FIGS. 10 through 13 is applicable to not only the case in which the data is received from the network but also the case in which multimedia data is transferred from an external memory medium while reproducing the transferred data or the multimedia data is received by radio or optical transmission while reproducing the received data.

In the above-mentioned constitutions, the flow returning to the process A is provided in the process B such as the processing of steps S62 and S63 for example in order to minimize the error occurrence in the music tone generation processing. However, if the invention is used under circumstance in which there is little chance for exceptional situations because, for example, the CPU power is large enough, the returning of the processing flow may be omitted. Steps S122, S124, S126, S127, and S128 shown in FIG. 13 also return the processing flow. It should be noted that, in the song file reproduction described with reference to FIGS. 1 through 9, error handling is not provided; however, the processing flow may be changed such that the error handling of step S129 shown in FIG. 13 in the stream reproduction described with reference to FIGS. 10 through 13 is performed.

So far, the example has been described in which duration information is used as a performance timing to be included in song data. Instead of using the duration information, clock information indicative of an absolute time from the head of a song for example may be used. In this case, without converting the duration information into the clock information data, the sound source parameter attached with this clock information is written to the P buffer. So far, the description has been made assuming a general-purpose personal computer. It will be apparent that the present invention may also be realized by use of a computer dedicated to a sound source. In the above-mentioned examples, the present invention is applied to the software sound source. It will be apparent that the present invention is also applicable to the hardware sound source. The term "music tone" denotes not only a tone generated by a musical instrument, but also a voice, sound effects, and other audible sounds in a broad sense. Consequently, the present invention is applicable as the music tone generating method for not only an electronic musical instrument, but also amusement devices such as game and karaoke and household appliances such as television.

As described and according to the present invention, the load of tone generation processing is distributed to eventually reduce the substantial processing load per time. As compared with the constitution in which waveform data is generated before the reproduction timing of a reproducing device, the novel constitution requires only a buffer of smaller storage size, thereby minimizing the storage size of the RAM used. When song data is downloaded from a network to reproduce waveform data, reproduction of a song can be started without waiting until the song data is all downloaded.

While the preferred embodiments of the present invention have been described using specific terms, such description is for illustrative purposes only, and it is to be understood that changes and variations may be made without departing from the spirit or scope of the appended claims.

What is claimed is:

1. A method of producing a progression of musical tones according to song data by means of a tone generator having a register, the method comprising the steps of:

providing the song data in the form of a sequence of event data effective to specify a musical tone to be produced and time data effective to indicate a timing of producing the musical tone;

sequentially retrieving the event data and the time data corresponding thereto from the provided song data;

converting the retrieved event data into control parameters effective to characterize the specified musical tone and reserving the control parameters together with the corresponding time data in a memory;

generating waveform data of the musical tone by operating the tone generator based on the control parameters, which are loaded from the memory into the register upon arriving of the timing indicated by the corresponding time data; and reading the waveform data to produce the musical tone in matching with the timing indicated by the corresponding time data, wherein the generating step has a priority over the converting step as the generating step must periodically operate the tone generator at a period to ensure the progression of the musical tones, while the converting step can be executed independently from the progression of the musical tones to reserve the control parameters in advance of the loading thereof into the register of the tone generator.

2. The method according to claim 1, wherein the converting step may convert the event data into the control parameters in a current period while temporarily suspending the operation of the tone generator in the current period so as to ensure the loading of the control parameters timely before the operation of the tone generator in the current period, in case that the converting step has not attended to conversion of the event data in advance to the current period.

3. The method according to claim 1, wherein the reading step reads the waveform data sequentially one period after another period to produce the progression of the musical tones timely at each period, and the generating step is triggered to start generation of waveform data for another period when the reading step starts reading of the waveform data for one period.

4. The method according to claim 1, wherein the converting step converts the event data into the control parameters in a preceding period allotted before the timing indicated by the corresponding time data, and the generating step generates the waveform data by using the control parameters in a succeeding period covering the timing indicated by the corresponding time data.

5. The method according to claim 1, further comprising the steps of receiving the sequence of the song data from an external data source, and writing the received sequence of the song data successively into another memory, and wherein the converting step can be commenced by retrieving the song data from said another memory without awaiting completion of writing of the sequence of the song data into said another memory.

6. The method according to claim 1, wherein the generating step-comprises executing a computer program by means of a CPU to compute the waveform data according to the control parameters transferred from the memory to the register.

7. A machine readable medium used in a music apparatus having a CPU for producing a progression of musical tones according to song data by means of a tone generator and a register, the medium containing program instructions executable by the CPU for causing the music apparatus to perform the steps of:

providing the song data in the form of a sequence of event data effective to specify a musical tone to be produced and time data effective to indicate a timing of producing the musical tone;

sequentially retrieving the event data and the time data corresponding thereto from the provided song data;

converting the retrieved event data into control parameters effective to characterize the specified musical tone and reserving the control parameters together with the corresponding time data in a memory;

generating waveform data of the musical tone by operating the tone generator based on the control parameters, which are loaded from the memory into the register upon arriving of the timing indicated by the corresponding time data; and reading the waveform data to produce the musical tone in matching with the timing indicated by the corresponding time data, wherein the generating step has a priority over the converting step as the generating step must periodically operate the tone generator at a period to ensure the progression of the musical tones, while the converting step can be executed independently from the progression of the musical tones to reserve the control parameters in advance of the loading thereof into the register of the tone generator.

8. The machine readable medium according to claim 7, wherein the converting step may convert the event data into the control parameters in a current period while temporarily suspending the operation of the tone generator in the current period so as to ensure the loading of the control parameters timely before the operation of the tone generator in the current period, in case that the converting step has failed to convert the event data at a previous period before the current period.

9. An apparatus for producing a progression of musical tones according to song data comprising:

a providing section that provides the song data in the form of a sequence of event data effective to specify a musical tone to be produced and time data effective to indicate a timing of producing the musical tone;

a retrieving section that sequentially retrieves the event data and the time data corresponding thereto from the provided song data;

a converting section that converts the retrieved event data into control parameters effective to characterize the specified musical tone;

a memory section that reserves the control parameters together with the corresponding time data;

a generating section including a tone generator and a register for generating waveform data of the musical tone by operating the tone generator based on the control parameters, which are loaded from the memory section into the register upon arriving of the timing indicated by the corresponding time data; and a reading section that reads the waveform data to produce the musical tone in matching with the timing indicated by the corresponding time data, wherein the generating section has a priority over the converting section as the generating section must periodically operate the tone generator at a period to ensure the progression of the musical tones, while the converting section can be operated separately from the progression of the musical tones to reserve the control parameters in advance of the loading thereof into the register of the tone generator.

10. The apparatus according to claim 9, wherein the converting section may convert the event data into the control parameters in a current period while temporarily suspending the operation of the tone generator in the current period so as to ensure the loading of the control parameters timely before the operation of the tone generator in the current period, in case that the converting section has failed conversion of the event data in advance to the current period.

* * * * *